US005904625A

United States Patent [19]

Shillingburg

[11] Patent Number: 5,904,625

[45] Date of Patent: May 18, 1999

[54] GOLF PUTTING PRACTICE DEVICE

[76] Inventor: Craig P. Shillingburg, 1513 E. Street, Golden, Colo. 80401

[21] Appl. No.: 09/149,423

[22] Filed: Sep. 8, 1998

[51] Int. Cl.[6] ..... A63B 69/36

[52] U.S. Cl. ..... 473/261; 473/241

[58] Field of Search ..... 473/257, 258, 473/260, 261, 264, 265, 405, 407

[56] References Cited

U.S. PATENT DOCUMENTS

| | | | |
|---|---|---|---|
| 3,232,623 | 2/1966 | Abrams et al. | 273/186 |
| 3,942,802 | 3/1976 | Wright | 273/186 C |
| 4,468,034 | 8/1984 | Duclos | 473/257 X |
| 5,011,154 | 4/1991 | Bowen | 273/192 |
| 5,273,284 | 12/1993 | Montgomery | 273/187.6 |
| 5,303,926 | 4/1994 | Owens et al. | 273/186.1 |
| 5,776,007 | 7/1998 | Kendall et al. | 473/261 X |

FOREIGN PATENT DOCUMENTS

| | | | |
|---|---|---|---|
| 2192797 | 1/1988 | United Kingdom | 273/192 |

*Primary Examiner*—George J. Marlo
*Attorney, Agent, or Firm*—Flanagan & Flanagan; John K. Flanagan; John R. Flanagan

[57] ABSTRACT

A golf putting practice device includes a support body and a rod. The support body includes a housing, a pair of front leg members and a rear leg member. Each front and rear leg member is pivotally mounted to the housing. Each front and rear leg member is movable between lower extended and upper stored positions. The rod in the form of a series of rod segments telescopingly extendable and retractable with respect to one another. The rod also has a series of markings thereon indicating different distances from the golf ball. The rod is at the first end mounted to the housing of the support body such that the rod is disposed partially within a central interior passageway of the housing and elevated a predetermined height above a surface. The device further includes a surface contour indicating arrangement which includes a base provided on the housing and a ball rollably on the base and a cover rotatably mounted to the base. The cover defines a first plurality of markings which together with the ball indicate the number of degrees the device is away from level and a second plurality of markings which indicate the degrees between the centerline of the rod and a line pointing at a target on the surface upon which the device is placed such that an angle between the rod and the target can be measured.

29 Claims, 6 Drawing Sheets

GOLF PUTTING PRACTICE DEVICE

BACKGROUND OF THE INVENTION

1. Field of the Invention

The present invention generally relates to devices for practicing golf strokes and, more particularly, is concerned with a golf putting practice device.

2. Description of the Prior Art

Golf is a popular pastime throughout the world. A golf stroke requires a solid stance, a consistent swing of a golf club and square contact of the golf club with a golf ball. Putting, in particular, also requires the stroke to be compact in that a putter follows a straight path from a starting position through a back swing to a follow through in a forward swing of the putter. Other factors which come into play in a golf stroke include the direction of the ball after it is hit by the club and the contour of a putting surface, such as slopes or breaks in and the texture and level of wetness of the surface. A golfer must practice strokes to achieve the solid stance, consistent swing and square contact, and to develop skill in establishing proper direction and in reading contours.

Various devices have been developed over the years to assist golfers in practicing strokes. Representative examples of these devices are disclosed in U.S. Pat. No. 3,232,623 to Abrams et al., U.S. Pat. No. 3,942,802 to Wright, U.S. Pat. No. 5,011,154 to Bowen, U.S. Pat. No. 5,273,284 to Montgomery, U.S. Pat. No. 5,303,926 to Owens et al. and U.K. Pat. No. 2,192,797 to Massie. Many of the prior art devices disclose one or more rods or rails providing a guide or line of sight for the golfer. While the prior art devices appear satisfactory in use for the specific purposes for which they were designed, none of the devices alone seem to enable the golfer to practice stance alignment, stroke mechanics, directional guidance and reading surface contours.

Consequently, a need still exists for a device which provides a more comprehensive solution for aiding golfers in practicing strokes.

SUMMARY OF THE INVENTION

The present invention provides a golf putting practice device designed to satisfy the aforementioned need. The golf putting practice device of the present invention alone enables the golfer to practice stance alignment, stroke mechanics, directional guidance and reading surface contours. The golf putting practice device is portable, easily moveable and positionable for use with every stroke. Proper use of the device allows the golfer to learn how to assess the results of a stroke and, through trial and error, teaches the golfer how to select the best stroke path.

Accordingly, the present invention is directed to a golf putting practice device which comprises: (a) a support body; and (b) a rod having opposite first and second ends and being telescopingly extendable and retractable so as to change the distance between its opposite ends and thereby adjust its length and dispose it at various working positions or at a stored position, the first end of the rod being mounted to the support body such that the rod extends from the support body in a cantilevered fashion and elevated a predetermined height above a putting surface so as to provide clearance for a golf ball and a head of a golf club below the rod, the second end of the rod being disposed at a desired distance from the first end so as to provide a straight line guide for a golfer in stroking the golf club to hit the golf ball.

More particularly, the rod is in the form of a series of rod segments each having a diameter less than the diameter of the previous one of the rod segments of the series extending from the first end of the rod. The rod has a knob attached to the second end thereof for gripping in order to extend and retract the rod. The rod has a series of markings thereon indicating different lengths of golf strokes.

The present invention is also directed to a golf putting practice device which comprises: (a) a support body including (i) a housing formed by an upper section and a lower section mounted to one another, each of the upper and lower sections having opposite front and rear ends, opposite lateral sides and opposite top and bottom sides, the upper and lower sections together defining a central interior passageway open at the front ends thereof, the lower section defining a lower recess open at the bottom side thereof, (ii) a plurality of leg members having opposite upper and lower ends, the upper ends of the leg members being pivotally mounted to the lower section of the housing at the bottom side thereof and the lower ends of the leg members for contacting a surface, each of the leg members being movable between lower extended positions and upper stored positions; and (b) a rod having opposite first and second ends, the first end of the rod being mounted to the housing adjacent to the rear ends of the upper and lower sections thereof such that the rod is disposed partially within the central interior passageway of the housing and elevated a predetermined height above the surface so as to provide clearance for a golf ball and a head of a golf club and the second end disposed a predetermined distance from the first end, the rod providing a guide for a golfer in stroking the golf club and hitting the golf ball.

The present invention is also directed to a golf putting practice device which comprises: (a) a support body; (b) a rod having opposite first and second ends, the first end mounted to the support body such that the rod is elevated a predetermined height above a surface so as to provide clearance for a golf ball and a head of a golf club and the second end disposed a predetermined distance from the first end, the rod providing a guide for a golfer in stroking the golf club and hitting the golf ball; and (c) means provided on the support body for indicating a contour of the surface upon which the device is placed.

More particularly, the surface contour indicating means includes a cup-shaped base having a concave bottom, a ball freely rollable on the concave bottom of the base on the support body, and a cover comprised of a substantially transparent material and mounted to and over the cup-shaped base on the support body and enclosing the ball therewithin. The cover defines a plurality of markings, with a first group of the markings being concentric circles and a second group of the markings being numbers indicating the number of degrees away from level, each of the numbers being disposed between adjacent ones of the concentric circles. The ball is restable on the bottom of the base below the first group of markings to thereby indicate the number of degrees away from level of a slope of the surface upon which the device is placed.

The cover is rotatable on the base and further defines an arrow disposed at zero degrees and upon rotation of the cover being alignable with a target on the surface upon which the device is placed. The cover also defines a third group of the markings being lines and numbers labeling at least some of the lines and indicating the number of degrees the cover has been rotated away from a centerline of the rod such that an angle between the rod and the target can be measured. The base has a continuous sidewall with an outer surface and an annular groove defined in and extending about the outer surface of the sidewall. The cover has a continuous sidewall with an inner surface and an annular bead defined on and extending about the inner surface and seated within the annular groove in the sidewall of the base for rotatably mounting the cover on the base. The cover also has an outer periphery with a series of parallel ribs thereon for aiding a user in gripping the cover to rotate the cover. The cover incorporates a magnifying lens.

These and other features and advantages of the present invention will become apparent to those skilled in the art upon a reading of the following detailed description when taken in conjunction with the drawings wherein there is shown and described an illustrative embodiment of the invention.

BRIEF DESCRIPTION OF THE DRAWINGS

In the following detailed description, reference will be made to the attached drawings in which.

DETAILED DESCRIPTION OF THE INVENTION

Figure 1:
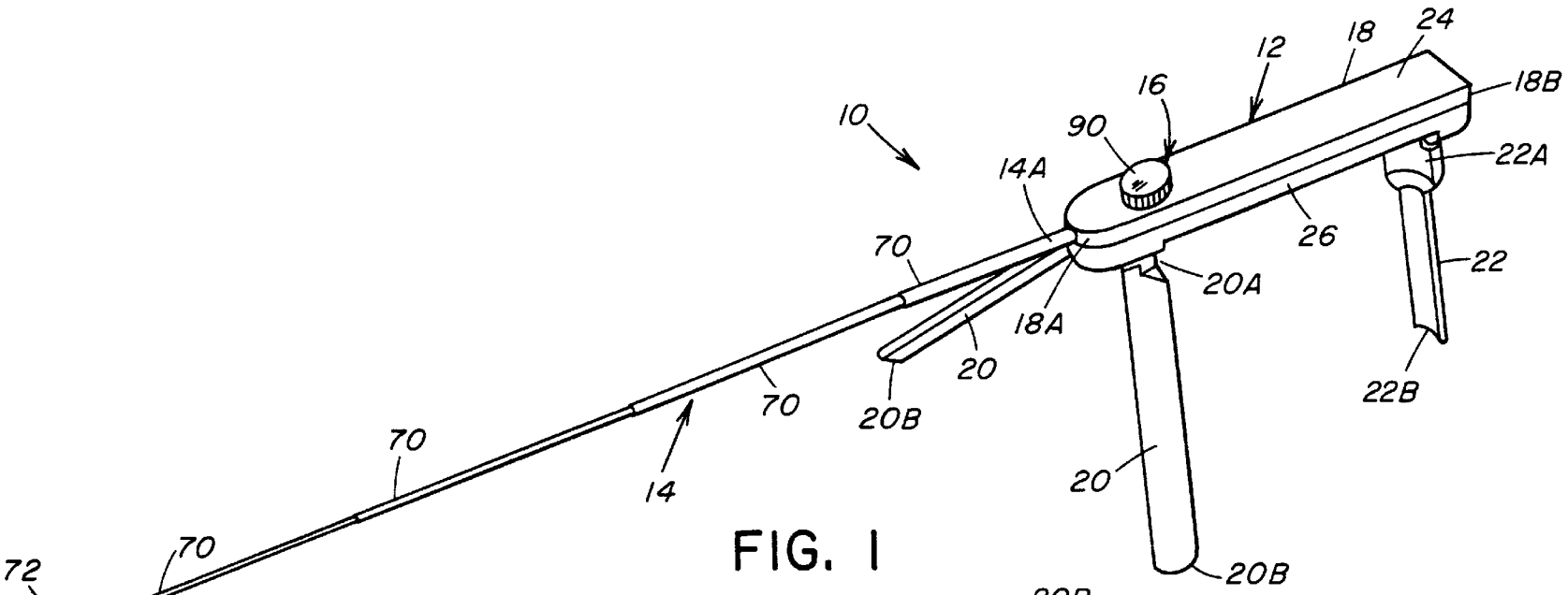
FIG. 1 is a perspective view of a golf putting practice device of the present invention showing its support body with front and rear leg members, extendable and retractable guide rod, and putting surface contour indicating means.
Figure 2:
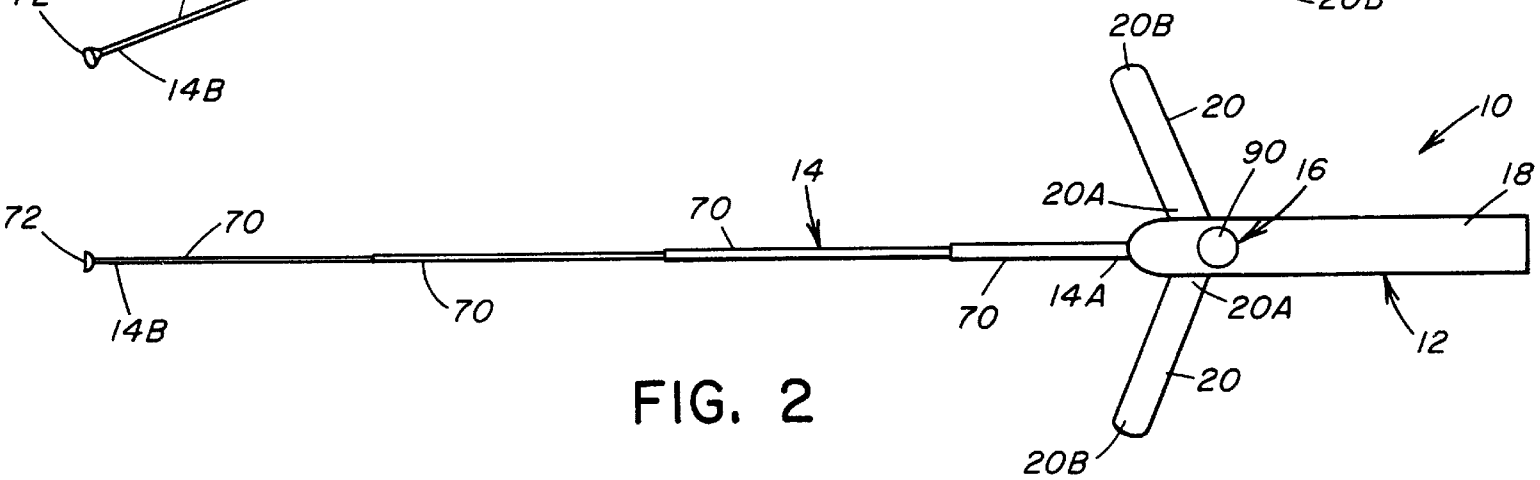
FIG. 2 is a top plan view of the practice device of FIG. 1.
Figure 4:
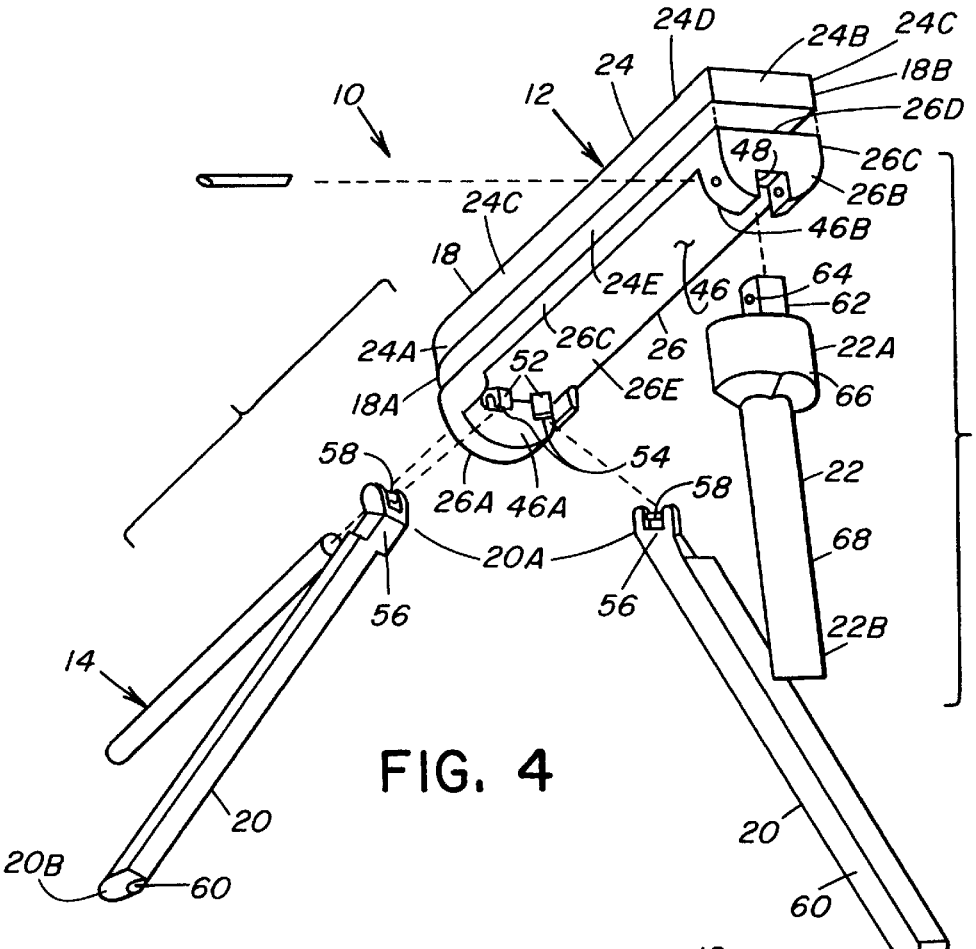
FIG. 4 is an exploded view of the practice device showing the guide rod and the upper and lower sections of the housing and the front leg members and rear leg member of the support body.
Figure 3:
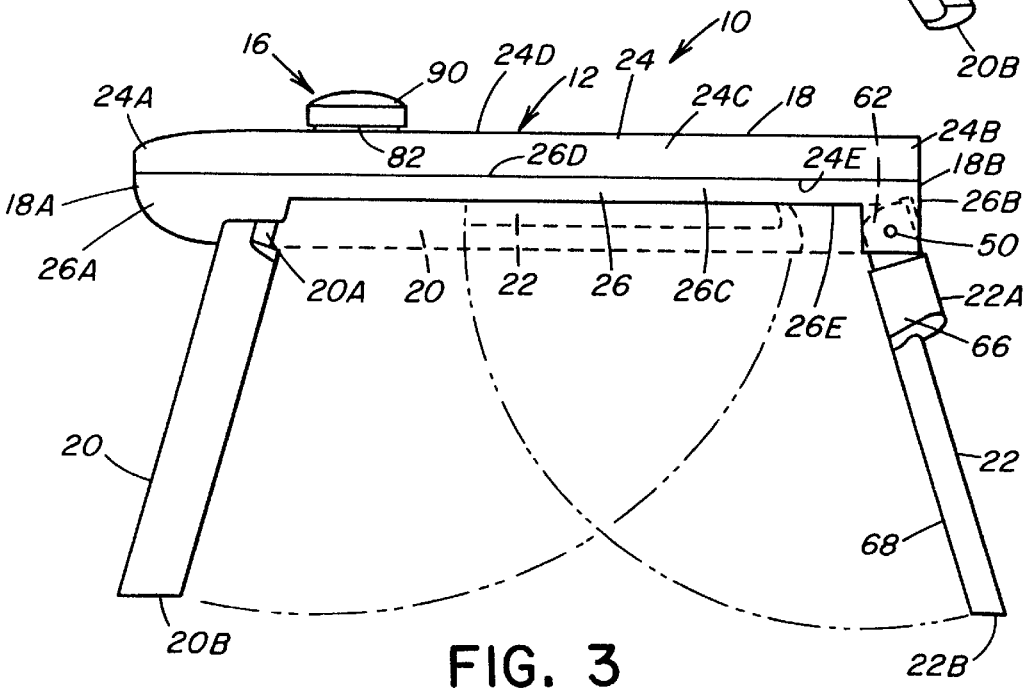
FIG. 3 is a side elevational view of the support body of the practice device of FIG. 1 showing a housing and front and rear leg members mounted to the housing for undergoing movement relative to the housing between upper stored positions as shown in dash line form and lower extended positions as shown in solid line form.
Figure 5:
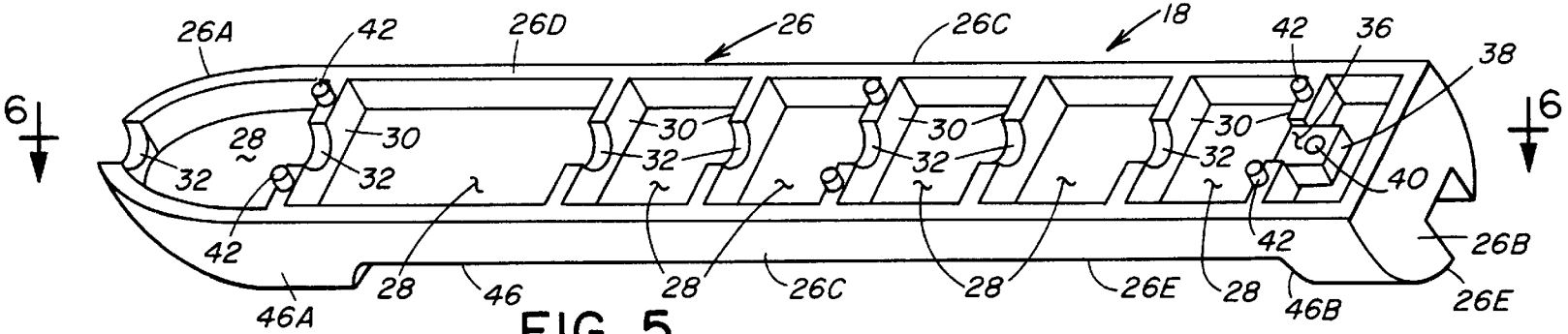
FIG. 5 is an enlarged perspective view of the lower section of the housing of the support body of the practice device.
Figure 6:
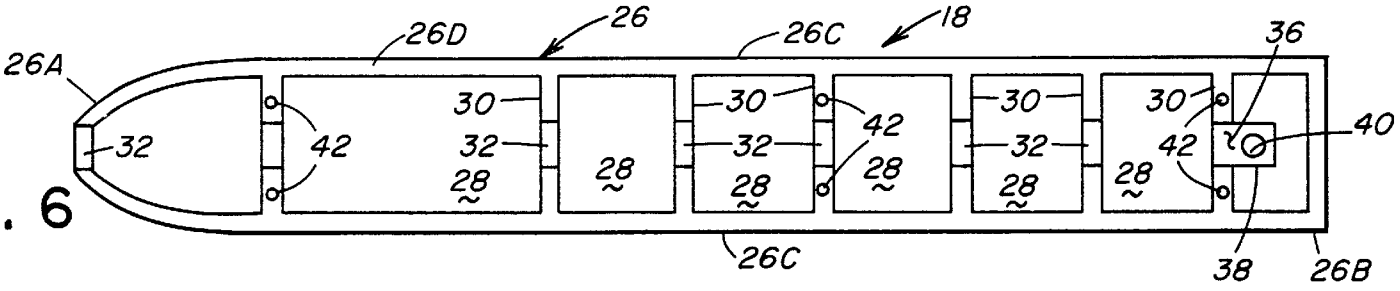
FIG. 6 is a top plan view of the lower housing section of the support body as seen along line 6—6 of FIG. 5.

Referring to the drawings and particularly to FIGS. 1, 2 and 13–17 there is illustrated a golf putting practice device, generally designated 10, of the present invention. Basically, the golf putting practice device 10 includes a support body 12, a guide or alignment rod 14 and a surface contour indicating means 16. The rod 14 has opposite first and second ends 14A, 14B and is telescopingly extendable and retractable so as to change the distance between its opposite ends 14A, 14B and thereby adjust its length and dispose it at various working positions or at a stored position. The first end 14A of the rod 14 is mounted to the support body 12 such that the rod 14 extends from the support body 12 in an outward cantilevered fashion and elevated a predetermined height above a putting surface S so as to provide clearance for a golf ball B and a head H of a golf club C therebelow. By telescopingly extending and retracting the rod, the second end 14B of the rod 14 can be disposed at a desired predetermined distance from the first end 14A of the rod 14. The rod 14 provides a guide for a golfer G in stroking the golf club C along a straight line for properly hitting the golf ball B.

Referring now to FIGS. 1 to 7, the support body 12 includes an elongated housing 18 and a plurality of leg members preferably including a pair of front leg members 20 and a rear leg member 22. The housing 18 has opposite front and rear ends 18A, 18B and mounts the rod 14 such that the rod 14 extends from the front end 18A of the housing 18. More particularly, the housing 18 is formed by an upper section 24 and a lower section 26 mounted to one another. Each of the upper and lower sections 24, 26 has opposite front and rear ends 24A, 26A and 24B, 26B, opposite lateral sides 24C, 26C and opposite top and bottom sides 24D, 26D and 24E, 26E. The top side 26D of the lower section 26 is substantially similar to the bottom side 24E of the upper section 24. Each of the bottom side 24E of the upper section 24 and top side 26D of the lower section 26 defines a series of compartments 28 separated by partitions 30. Each partition 30 extends between and in substantially perpendicular relation to the opposite lateral sides 24C, 26C. Each compartment 28, but for the compartment adjacent to the front end 24A, 26A of each of the upper and lower sections 24, 26 has a substantially rectangular configuration when viewed from above or below. Each partition 30 defines a central recess 32. Each front end 24A, 26A of the upper and lower sections 24, 26 also defines a central recess 32. Each central recess 32 has a substantially semicircular configuration. Each central recess 32 is aligned with all of the other central recesses 32. The upper and lower sections 24, 26 together define a central interior passageway 34 open at the front ends 24A, 26A thereof. The central interior passageway 34 is formed by the central recesses 32 on the front ends 24A, 26A and the partitions 30 of the upper and lower sections 24, 26. The opposite lateral sides 24C, 26C of the upper and lower sections 24, 26 run substantially in parallel to one another from the rear ends 24B, 26B and for most of a length of the upper and lower sections 24, 26 and then taper to the central recesses 32 of the front ends 24A, 26A. The partition 30 closest to the rear end 26B of the lower section 26 does not define a central recess 32 but rather defines a central gap 40. The lower section 26 has a block 38 disposed within the central gap 40 and extending into the compartment 28 adjacent to the rear end 26B. The block 38 defines a hole 44. A first and last of the partitions 30 of each of the upper and lower sections 24, 26 have a pair of pins 42 or define a pair of holes 44. The pins 42 and holes 44 are disposed on opposite sides of the central recess 32 of the partition 30. The pins 42 interfit with the holes 44 and thereby mount the upper and lower sections 24, 26 to one another. The compartment 28 adjacent to the rear end 24B, 26B of each of the upper and lower sections 24, 26 is smaller than all of the other compartments 28. The compartment 28 adjacent to the front end 24A, 26A of each of the upper and lower sections 24, 26 is larger than all of the other compartments 28. The compartment 28 adjacent to the front end 24A, 26A of each of the upper and lower sections 24, 26 is curved at and conforms to the tapering of the opposite lateral sides 24C, 26C of the upper and lower sections 24, 26. One or more counterweights (not shown), if needed, may be inserted in the compartments 28 to offset the weight of the rod 14 when extended.

The lower section 26 defines a lower recess 46 open at the bottom side 26E thereof. The lower recess 46 has a substantially rectangular configuration and extends most of the length of the lower section 26. The front end 46A of the lower recess 46 is disposed farther from the front end 26A of the lower section 26 than the rear end 46B of the lower recess 46 is disposed relative to the rear end 26B of the lower section 26. The lower section 26 also defines a slot 48 adjacent to the rear end 46B of the lower recess 46 which is exposed to the lower recess 46 and extends toward but is spaced interiorly from the rear end 26B of the lower section 26. The slot 48 is disposed centrally and is in vertical alignment with the central recesses 32 of the partitions 30 on the top side 26D of the lower section 26. The lower section 26 also has a pin 50 disposed horizontally within and extending between and mounted to opposite sides of the slot 48. The lower section 26 also has a pair of tabs 52 mounted to the bottom side 26E within and adjacent to the front end 46A of the lower recess 46. Each tab 52 is spaced from one of the opposite lateral sides 26C and from the other tab 52. The tabs 52 are disposed in substantially diagonal relation to one another, converging toward the front end 26A and diverging toward the rear end 26B of the lower section 26. Each tab 52 defines a slot 54 open at a side thereof opposite from the bottom side 26E of the lower section 26 and extending a length of the tab 52. The slot 54 has a substantially cylindrical configuration.

Each front leg member 20 has opposite upper and lower ends 20A, 20B. The upper end 20A of each front leg member 20 is pivotally mounted to the lower section 26 of the housing 18 at the bottom side 26E thereof adjacent to the front end 26A and closer to one of the lateral sides 26C than to the other of the lateral sides 26C of the lower section 26. The lower end 20B of each front leg member 20 is for contacting the surface S. Each front leg member 20 is movable between lower extended and upper stored positions. In the lower extended position, each front leg member 20 extends substantially diagonally down and away from the bottom side 26E of the lower section 26 and the lower end 20B contacts the surface S. In the upper stored position, each front leg member 20 extends substantially horizontally within the lower recess 46 of the lower section 26. The front leg members 20 diverge from one another in moving from the upper stored to the lower extended positions and converge toward one another in moving from the lower extended to the upper stored positions.

Each front leg member 20 defines a slot 56 at the upper end 20A thereof. The slot 56 has a size slightly greater than one of the tabs 52 of the lower section 26 for fitting one of the tabs 52 therein. Each front leg member 20 also has a pin 58 disposed horizontally within and extending between and mounted to opposite sides of the slot 56. The pin 58 fits snugly and is rotatable within the slot 54 of one of the tabs 52 such that the front leg member 20 is pivotal in relation to the lower section 26 for moving between its lower extended and upper stored positions. Each front leg member 20 is substantially uniform in transverse cross-section for most of its length. Each front leg member 20 further defines a longitudinal side recess 60 on a side thereof which in the upper stored position faces the longitudinal side recess 60 of the other front leg member 20 and is also directed upwardly therefrom.

The rear leg member 22 has opposite upper and lower ends 22A, 22B. The upper end 22A of the rear leg member 22 is pivotally mounted to the lower section 26 of the housing 18 at the bottom side 26E thereof adjacent to the rear end 26B of the lower section 26. The lower end 22B of the rear leg member 22 is for contacting the surface S. The rear leg member 22 is movable between lower extended and upper stored positions. In the lower extended position, the rear leg member 22 extends downwardly at a backward angle to vertical below the bottom side 26E of the lower section 26 and the lower end 22B contacts the surface S. In the upper stored position, the rear leg member 22 extends substantially horizontally within the lower recess 46 of the lower section 26.

The rear leg member 22 has a tab 62 mounted to the upper end 22A. The tab 62 defines a hole 64 extending the width of the tab 62 and of substantially cylindrical configuration. The slot 48 at the rear end 46B of the lower recess 46 in the lower section 26 has a size slightly greater than the tab 62 of the rear leg member 22 for fitting the tab 62 therein. The pin 50 applied across the slot 48 of the lower section 26 fits through the hole 64 of the tab 62 such that the rear leg member 22 is pivotal in relation to the lower section 26 for moving between its lower extended and upper stored positions. The rear leg member 22 further has a head portion 66 and a tail portion 68. The head portion 66 is enlarged in comparison to the tail portion 68. The head portion 66 has a shape which conforms to the shape of the lower section 26 between the rear end 26B and the lower recess 46. The tab 62 is disposed on top of the head portion 66 and has a size substantially less than the head portion 66. The tail portion 68 has a shape which conforms to the shape of the space which is left in the lower recess 46 of the lower section 26 and in the longitudinal side recesses 60 of the front leg members 20 when the front leg members 20 are in their upper stored positions. The rear leg member 22 is placed in its upper stored position before the front leg members 20 are so placed. The front leg members 20 are then placed into their lower extended positions before the rear leg member 22 is so placed. When in their upper stored positions, the leg members 20, 22 provide a substantially continuous and smooth surface which is flush with the bottom side 26E on both sides of the lower recess 46 of the lower section 26. The front leg members 20 may also have a gripping surface formed adjacent to their lower ends 20B for aiding a user in moving the front leg members 20 from their upper stored positions. The support body 12 can be comprised of a substantially plastic material.

Referring now to FIGS. 1, 2, 11 and 12, as mentioned above the rod 14 is telescopingly extendable and retractable. The rod 14 is in the form of a series of rod segments 70. Each rod segment 70 has a diameter less than the diameter of the previous one of the rod segments 70 of the series extending from the first end 14A of the rod 14. This relationship of the rod segments 70 to one another give the rod 14 an antennae-like appearance. The diameter of the rod segment 70 of the series thereof at the first end 14A of the rod 14 is less than a diameter of a standard golf ball B such that the golf ball B can be seen from above the rod 14 by the golfer G. The rod 14 has a predetermined length sufficient to accommodate a length of most full swings of a golf club C used for putting on a green of a golf course. The rod 14 has a knob 72 attached to the second end 14B thereof. The knob 72 is for gripping in extending and retracting the rod 14. The knob 72 has a diameter greater than the diameter of the rod segment 70 to which the knob 72 is attached so as to provide a gripping element for the golfer to use in extending and retracting the rod segments 70. The rod 14 can be comprised of a substantially metal or plastic material.

The rod 14 also has a series of markings 74 thereon indicating different distances from the golf ball B to end the back swing and start the forward swing, and thereby gauge the golf club speed. In one embodiment, shown in FIG. 11, the markings 74 may be in the form of dashes 76 indicating different distances from the golf ball B. In another embodiment, shown in FIG. 12, the markings 74 may be in the form of different color coatings 78 on the rod segments 70 of the rod 14 indicating ranges of different distances from the golf ball B. The ranges may be, for exemplary purposes only, under 3 feet, 3 to 7 feet, 7 to 15 feet and over 15 feet.

Figure 7:
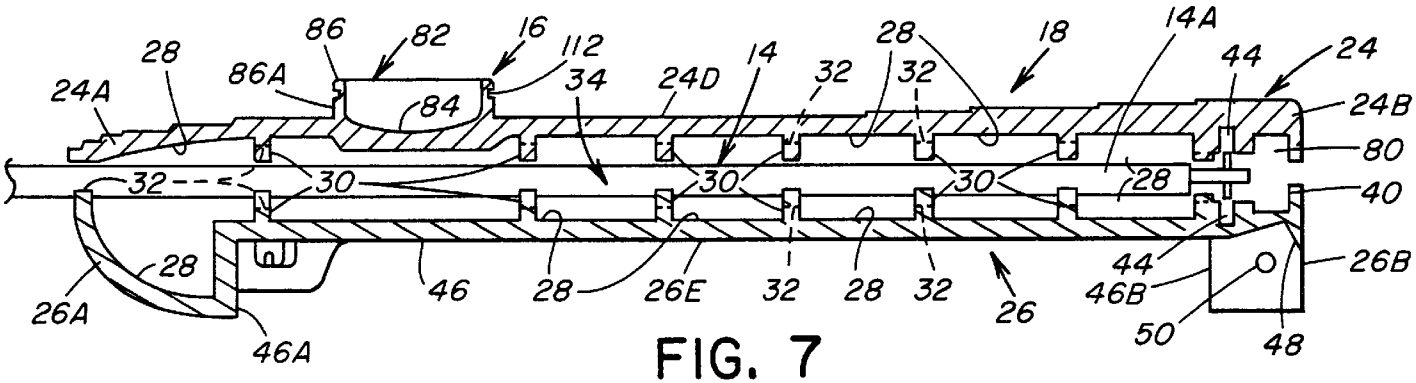
FIG. 7 is an exploded longitudinal sectional view of the upper and lower sections of the housing of the support body.
Figure 9:
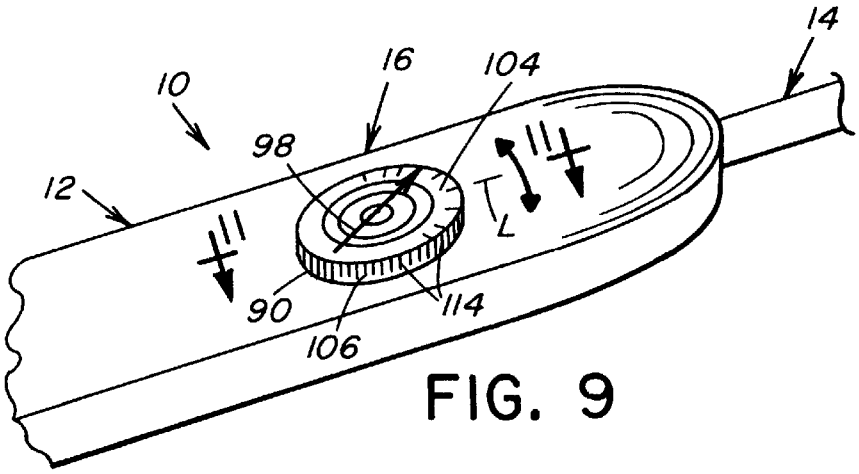
FIG. 9 is a perspective view of the surface contour indicating means assembled on the housing of the support body with arrows indicating opposite directions of possible rotation of the cover.
Figure 8:
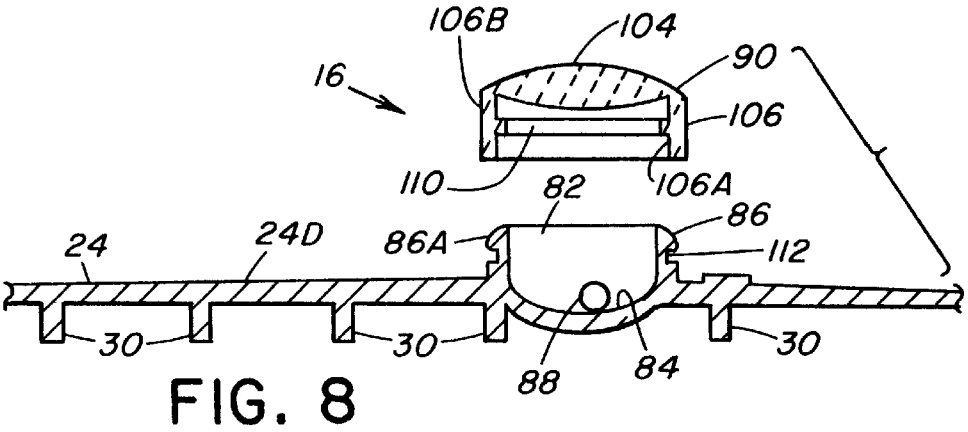
FIG. 8 is an exploded view of the surface contour indicating means of the practice device showing a cup-shaped base on the support body, a ball freely rollable on the base and a cover rotatably mounted to and over the base and enclosing the ball.
Figure 10:
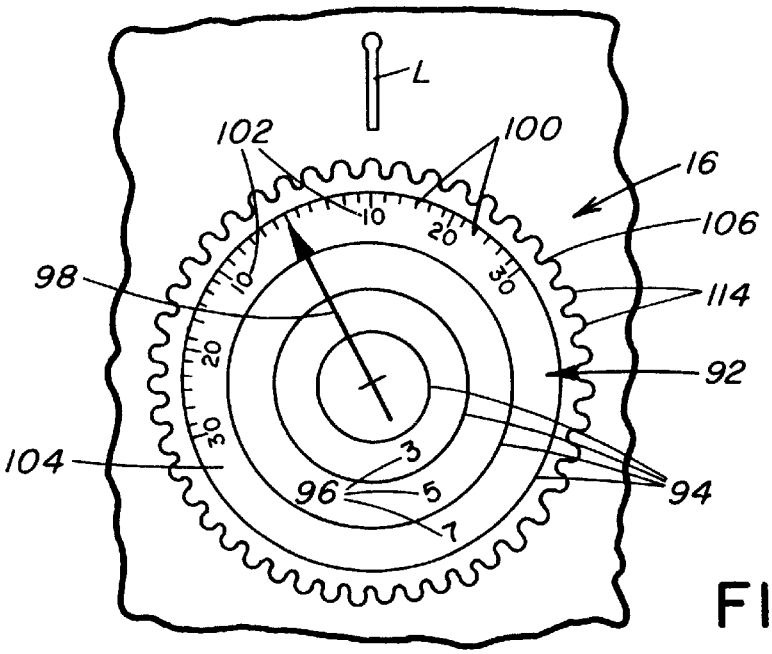
FIG. 10 is a top plan view of the surface contour indicating means as seen along line 10—10 of FIG. 9 showing details of the cover thereof.
Figure 11:
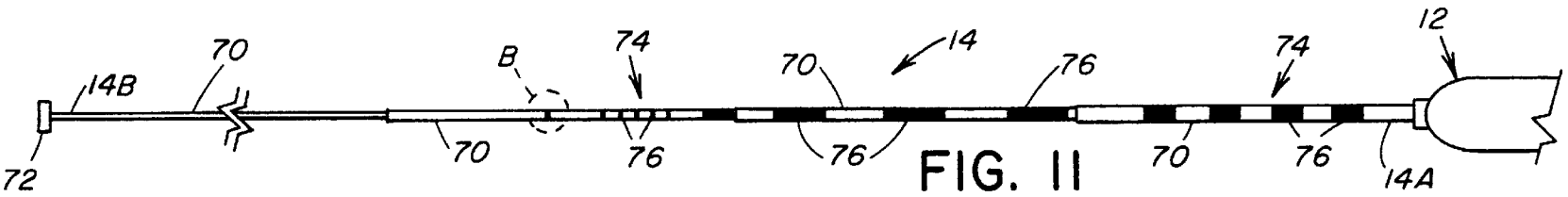
FIG. 11 is a fragmentary top plan view of the rod of the practice device having a series of markings thereon in the form of dashes indicating different distances from the golf ball at which a golfer might start a golf stroke.
Figure 12:
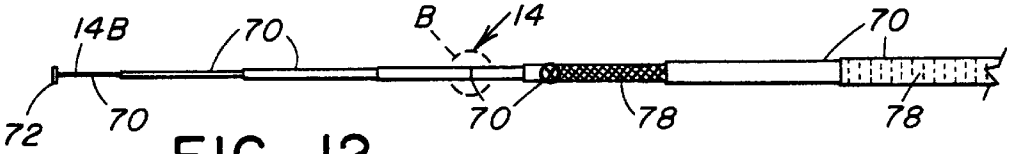
FIG. 12 is a fragmentary top plan view of the rod of the device having a series of markings thereon in the form of different color coatings on rod segments of the rod indicating ranges of different distances from the golf ball.
Figure 17:
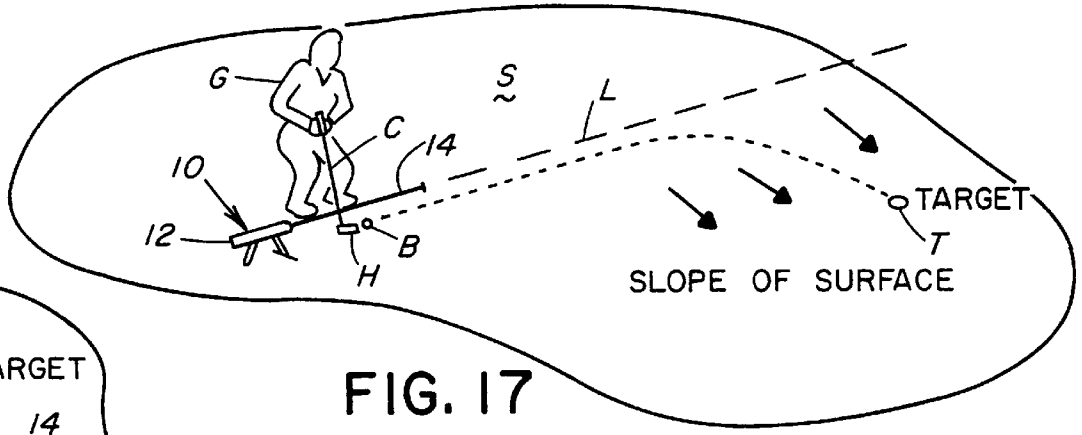
FIG. 17 is a diagrammatic view of a putting surface showing a site line in longer dashed lines, a perceived path of the golf ball to the target in shorter dashed lines and the slope of the surface with arrows.
Figure 16:
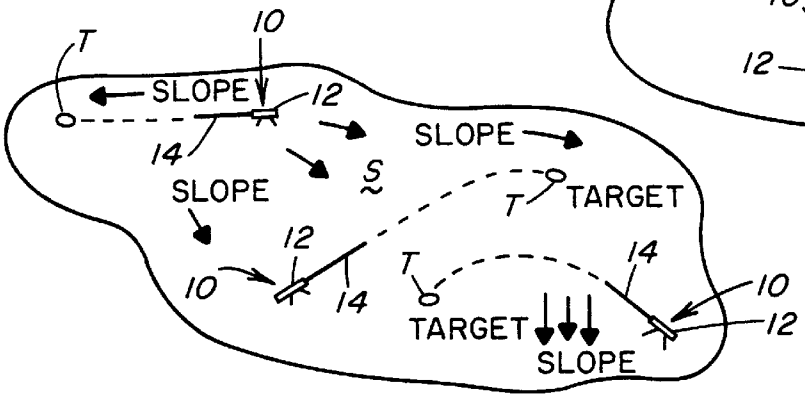
FIG. 16 is a diagrammatic view of a putting surface showing use of the practice device in different locations on the surface and movement of golf balls in dashed line paths from the devices and the effects on the paths of movement of the golf balls due to changes in the contour of the surface shown with arrows.
Figure 15:
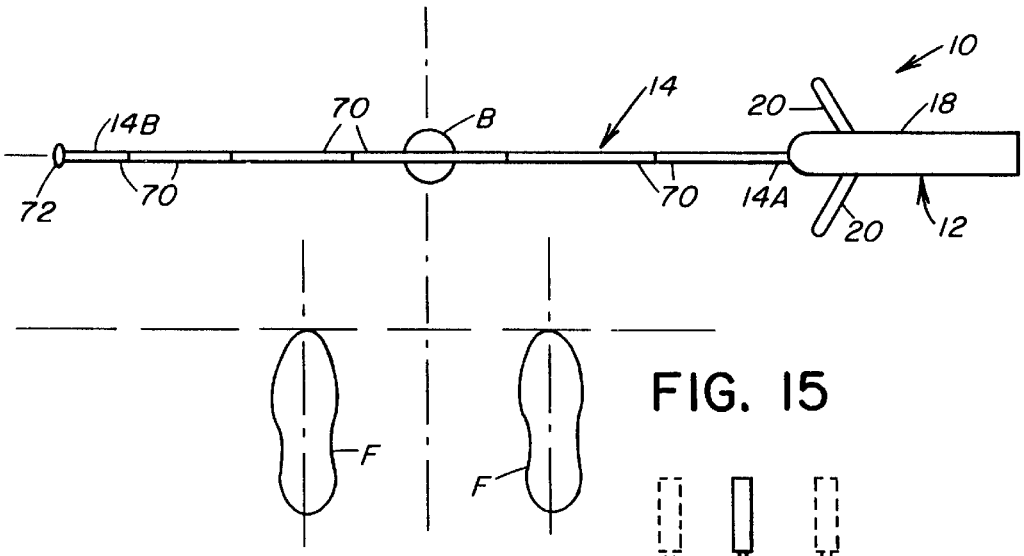
FIG. 15 is a top plan view of the practice device showing a stance alignment of a golfer in relation to the device.
Figure 14:
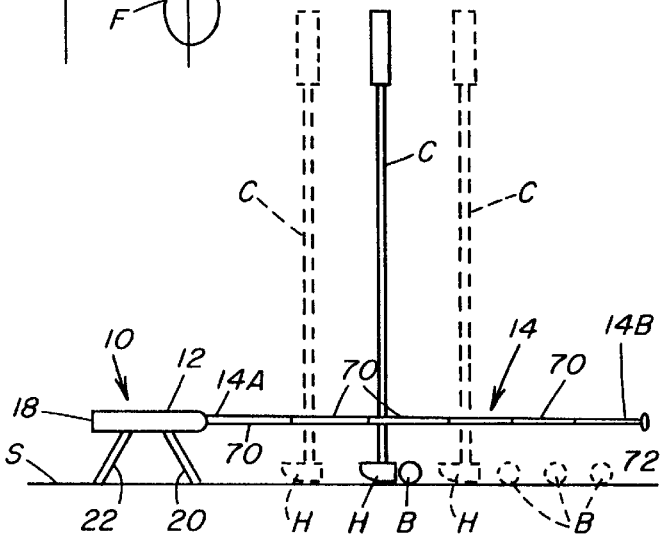
FIG. 14 is a side elevational view of the practice device showing the positions of the putting golf club of FIG. 13 and movement of the golf ball in dash line form after the stroke of the putting golf club.
Figure 13:
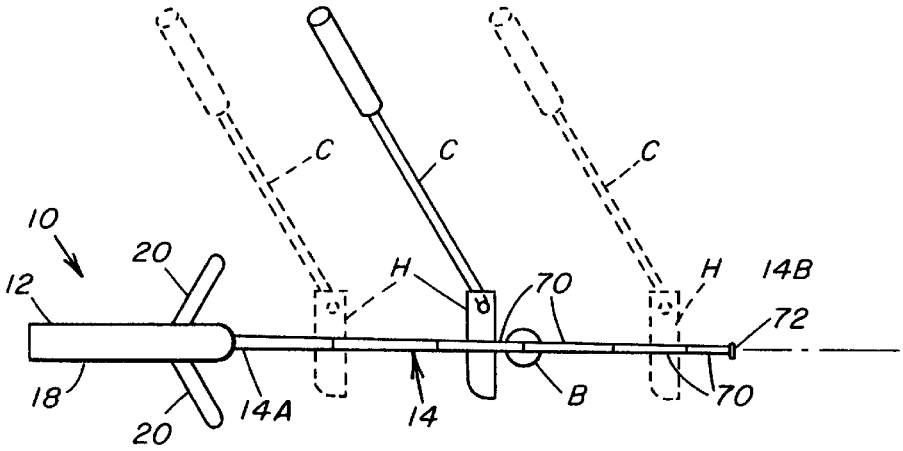
FIG. 13 is a top plan view of the practice device showing a golf ball and putting golf club along the rod of the device in a starting position of a stroke in solid line form and in a backswing position and a follow through position of the stroke in dash line form.

Referring also to FIG. 7, the rod 14 is, more particularly, at its first end 14A mounted to the housing 18 adjacent to the rear ends 24B, 26B of the upper and lower sections 24, 26 thereof such that the rod 14 is disposed partially within the central interior passageway 34 of the housing 18 and elevated the predetermined height above the putting surface S. The diameter of the rod segment 70 at the first end 14A of the rod 14 is slightly less than a diameter of the central interior passageway 34 of the housing 18 for snugly fitting the rod segment 70 therethrough. The rod 14 also has a pin 80 extending downward from the first end 14A thereof. The pin 80 fits in the hole 40 of the block 38 in the compartment 28 which is adjacent to the rear ends 24B, 26B of the upper and lower sections 24, 26 of the housing 18. The pin 80 in the hole 40 secures the rod 14 within the housing 18 of the support body 12.

Referring now to FIGS. 7 to 10, the surface contour indicating means 16 includes a cup-shaped base 82 defined on the top side 24D of the upper section 24 of the housing 18 of the support body 12 with a concave bottom 84 in the base 82 and a continuous side wall 86 surrounding the bottom 84 of and extending upwardly from the base 82. The surface contour indicating means 16 also includes a ball 88 and a cover 90. The ball 88 is freely moveable or rollable on the concave bottom 84 of the base 84. The cover 90 is made of a substantially transparent material providing a magnifying lens and, particularly, a double convex lens. The cover 90 is mounted to and over the base 82 and encloses the ball 88 between the base 82 and cover 90.

The cover 90 defines a plurality of markings 92. A first group of the markings 92 are concentric circles 94. A second group of the markings 92 are numbers 96 disposed between adjacent ones of the concentric circles 94 indicating the number of degrees from a level condition. The level condition is where the legs 20, 22 are either stored or extended and the device 10 is on a level surface. As an example, the numbers 96 may be 1, 3, 5 and 7 degrees. The concentric circles 94 may number three or be of any other suitable number. The ball 88 is restable on the concave bottom 84 of the base 82 on the upper section 24 of the housing 18 of the support body 12 and below the concentric circles 94 and thereby indicates the number of degrees away from level of a slope of the putting surface S upon which the device 10 is placed. The magnification of the cover 90 enables a golfer G to more easily see the ball 88 in relation to the concentric circles 94 and numbers 96.

The cover 90 is rotatable on the base 82 and further defines an arrow 98 disposed at zero degrees. Upon rotation of the cover 90 the arrow is alignable with a target T, such as a hole on the putting surface S, upon which the device 10 is placed. The cover 90 also includes a third group of the markings 92 in the form of lines 100 and numbers 102 labeling at least some of the lines 100 and indicating the number of degrees the cover 90 has been rotated away from a centerline L of the rod 14 such that the angle between the rod 14 and the target can be measured. As an example, the lines 100 are in two degree increments and go up to 30 degrees on either side of the centerline L of the rod 14.

The cover 90, more particularly, has a top wall 104 and a continuous side wall 106 extending downwardly from the top wall 104 at a periphery 108 thereof. The plurality of markings 92 are particularly formed on the top wall 104. The continuous side wall 106 has an annular ledge or bead 110 formed on an inner surface 106A and extending about the circumference thereof. The continuous side wall 106 of the cover 90 has a diameter slightly greater than a diameter of the continuous upper side wall 86 of the base 82 such that the cover 90 fits over the continuous upper side wall 86. The annular bead 110 of the continuous side wall 106 fits within and seats on an annular groove 112 defined in the outer surface 86A of the side wall 86 of the base 82 and thereby rotatably mounts and secures the cover 90 to the continuous upper side wall 86 of the base 82 and over the ball 88 on the bottom 84 of the base 82. The side wall 106 of the cover 90 also has an outer surface 106B with a series of parallel ribs 114 thereon for aiding a golfer in gripping and rotating the cover 90 relative to the base 82.

In summary, referring to FIGS. 13–17, the golf putting practice device 10 can be used alone by the golfer G to practice stance alignment, stroke mechanics, directional guidance and reading surface contours. In regard to stance alignment, the device 10 provides the golfer G with a visual guide in the form of the rod 14. The feet F of the golfer G can be positioned in relation to the rod 14. In regard to stroke mechanics, the device 10 also provides the golfer G with a straight, freestanding and unobstructed guide, again in the form of the rod 14. The device 10 permits the golfer G to make a stroke without physically restricting the golfer G. Repeated use of the device 10 with each stroke allows the golfer G to get a feel for the putting motion with a goal being that the golfer G becomes more consistent with each stroke. In regard to directional guidance, the device 10 provides the golfer G with a physical pointer which is portable, easily moveable and randomly positionable in 360 degrees. The device 10 can therefore be used with every stroke so that the golfer G may learn how to assess the results of a stroke and, through trial and error, how to select the best stroke path. In regard to reading surface contours, the device 10 provides the golfer G with a means 16 to determine the extent of a slope in the surface S. The device 10 informs the golfer G how many degrees out of level exists at a particular location on the surface S. The golfer G may then realign the rod 14 to compensate for the slope in the surface S. In this way, the golfer G may become more adept at figuring how much the golf ball B may break or deviate from a direct path toward a hole or other target.

It is thought that the present invention and its advantages will be understood from the foregoing description and it will be apparent that various changes may be made thereto without departing from the spirit and scope of the invention or sacrificing all of its material advantages, the form hereinbefore described being merely preferred or exemplary embodiment thereof.

I claim:

1. A golf putting practice device, comprising:

(a) a support body; and (b) a rod having opposite first and second ends and being telescopingly extendable and retractable so as to change the distance between said opposite first and second ends and thereby adjust the length of said rod and dispose said rod at various working positions and at a stored position, said rod at said first end thereof being mounted to said support body such that said rod extends from said support body in a cantilevered fashion and elevated a predetermined height above a putting surface so as to provide clearance for a golf ball and a head of a golf club below said rod, said second end of said rod being disposed at a desired distance from said first end so as to provide a straight line guide for a golfer in stroking the golf club to hit the golf ball; and (c) said support body includes:

a housing having opposite front and rear ends and mounting said rod such that said rod extends from said front end of said housing; and a plurality of leg members having opposite upper and lower ends, said upper ends of said leg members being pivotally mounted to said housing, said lower ends of said leg members for contacting a surface, each of said leg members being movable between a lower extended position and an upper stored position.

2. The device of claim 1 wherein said rod is in the form of a series of rod segments each having a diameter less than said diameter of the previous one of said rod segments of said series extending from said first end of said rod.

3. The device of claim 1 wherein said rod has a knob attached to said second end thereof for gripping to extend and retract said rod.

4. The device of claim 1 wherein said rod has a series of markings thereon indicating different distances from the golf ball at which a golfer can start a forward golf club stroke.

5. The device of claim 1 wherein said plurality of leg members includes a pair of front leg members each having said opposite upper and lower ends, said upper end of each of said front leg members being pivotally mounted to said housing adjacent to said front end thereof, said lower end of each of said front leg members for contacting a surface, each of said front leg members being movable between said lower extended and upper stored positions, said front leg members diverging away from one another in moving from said upper stored to said lower extended positions and converging toward one another in moving from said lower extended to said upper stored positions.

6. The device of claim 5 wherein said plurality of leg members further includes a rear leg member having said opposite upper and lower ends, said upper end of said rear leg member being pivotally mounted to said housing adjacent to said rear end thereof, said lower end of said rear leg member for contacting the surface, said rear leg member being movable between lower extended and upper stored positions.

7. The device of claim 1 further comprising:

means provided on said support body for indicating a contour of the surface upon which said device is placed, said surface contour indicating means including (i) a cup-shaped base defined on said support body having a concave bottom, (ii) a ball freely rollable on said concave bottom of said base, and (iii) a cover of a substantially transparent material mounted to and over said base and enclosing said ball between said base and cover, said cover defining a plurality of markings.

8. The device of claim 7 wherein a first group of said markings on said cover are concentric circles and a second group of said markings are numbers disposed between adjacent ones of said concentric circles and indicating degrees away from level, said ball being restable on said concave bottom of said base below said first group of markings and thereby indicating degrees away from level of a slope of the surface upon which said device is placed.

9. The device of claim 8 wherein said cover is rotatable on said base and further defines an arrow disposed at zero degrees and upon rotation of said cover being alignable with a target on the surface upon which said device is placed and a third group of said markings being lines and numbers labeling at least some of said lines and indicating the number of degrees said cover has been rotated away from a centerline of said rod such that an angle between said rod and the target can be measured.

10. The device of claim 7 wherein:

said base has a continuous side wall with an outer surface and an annular groove defined in and extending about said outer surface of said side wall; and said cover has a continuous side wall with an inner surface and an annular bead defined on and extending about said inner surface and seated within said annular groove in said side wall of said base for rotatably mounting said cover on said base.

11. The device of claim 7 wherein said cover has an outer surface with a series of parallel ribs thereon for aiding a golfer in gripping and rotating said cover.

12. The device of claim 7 wherein said cover incorporates a magnifying lens.

13. A golf putting practice device, comprising:

(a) a support body including (i) an elongated housing formed by an upper section and a lower section mounted to one another, each of said upper and lower sections having opposite front and rear ends, opposite lateral sides and opposite top and bottom sides, said upper and lower sections together defining a central interior passageway open at said front ends thereof, said lower section defining a lower recess open at said bottom side thereof, and (ii) a plurality of leg members having opposite upper and lower ends, said upper ends of said leg members being pivotally mounted to said lower section of said housing at said bottom side thereof and said lower ends of said leg members for contacting a surface, each of said leg members being movable between a lower extended position and an upper stored position; and (b) a rod having opposite first and second ends, said first end of said rod being mounted to said housing adjacent to said rear ends of said upper and lower sections thereof such that said rod is disposed partially within said central interior passageway of said housing and elevated a predetermined height above the surface so as to provide clearance for a golf ball and a head of a golf club and said second end disposed a predetermined distance from said first end, said rod providing a guide for a golfer in stroking the golf club and hitting the golf ball.

14. The device of claim 13 wherein said plurality of leg members includes a pair of front leg members each having said opposite upper and lower ends, said upper end of each of said front leg members being pivotally mounted to said lower section of said housing at said bottom side thereof adjacent to said front end and closer to one of said lateral sides than to the other of said lateral sides of said lower section of said housing, said lower end of each of said front leg members for contacting a surface, each of said front leg members being movable between said lower extended and upper stored positions, said front leg members diverging away from one another in moving from said upper stored to said lower extended positions and converging toward one another in moving from said lower extended to said upper stored positions, said lower recess of said lower section of said housing for storing said front leg members in said upper stored positions.

15. The device of claim 14 wherein said plurality of leg members further includes a rear leg member having said opposite upper and lower ends, said upper end of said rear leg member being pivotally mounted to said lower section of said housing at said bottom side thereof adjacent to said rear end of said lower section of said housing, said lower end of said rear leg member for contacting the surface, said rear leg member being movable between lower extended and upper stored positions, said lower recess of said lower section of said housing for storing said rear leg member in said upper stored positions.

16. The device of claim 13 further comprising:

means provided on said upper section of said housing of said support body for indicating a contour of the surface upon which said device is placed, said surface contour indicating means including (i) a cup-shaped base defined on said upper section of said housing having a concave bottom, (ii) a ball freely rollable on said concave bottom of said base, and (iii) a cover of a substantially transparent material mounted to and over said base and enclosing said ball between said base and cover, said cover defining a plurality of markings.

17. The device of claim 16 wherein a first group of said markings on said cover are concentric circles and a second group of said markings are numbers disposed between adjacent ones of said concentric circles and indicating degrees away from level, said ball being restable on said concave bottom of said base below said first group of markings and thereby indicating degrees away from level of a slope of the surface upon which said device is placed.

18. The device of claim 17 wherein said cover is rotatable on said base and further defines an arrow disposed at zero degrees and upon rotation of said cover being alignable with a target on the surface upon which said device is placed and a third group of said markings being lines and numbers labeling at least some of said lines and indicating the number of degrees said cover has been rotated away from a centerline of said rod such that an angle between said rod and the target can be measured.

19. The device of claim 16 wherein:

said base has a continuous side wall with an outer surface and an annular groove defined in and extending about said outer surface of said side wall; and said cover has a continuous side wall with an inner surface and an annular bead defined on and extending about said inner surface and seated within said annular groove in said side wall of said base for rotatably mounting said cover on said base.

20. The device of claim 19 wherein said cover has an outer surface with a series of parallel ribs thereon for aiding a golfer in gripping and rotating said cover.

21. The device of claim 16 wherein said cover incorporates a magnifying lens.

22. A golf putting practice device, comprising:

(a) a support body;

(b) a rod having opposite first and second ends, said first end mounted to said support body such that said rod is elevated a predetermined height above a surface so as to provide clearance for a golf ball and a head of a golf club and said second end disposed a predetermined distance from said first end, said rod providing a guide for a golfer in stroking the golf club and hitting the golf ball; and (c) means provided on said support body for indicating a contour of the surface upon which said device is placed.

23. The device of claim 22 wherein said support body includes:

a housing having opposite front and rear ends and mounting said rod such that said rod extends from said front end of said housing; and a plurality of leg members having opposite upper and lower ends, said upper ends of said leg members being pivotally mounted to said housing, said lower ends of said leg members for contacting a surface, each of said leg members being movable between a lower extended position and an upper stored positions.

24. The device of claim 22 wherein said surface contour indicating means includes:

a cup-shaped base defined on said support body having a concave bottom;

a ball freely rollable on said concave bottom of said base; and a cover of a substantially transparent material mounted to and over said base and enclosing said ball between said base and cover, said cover defining a plurality of markings.

25. The device of claim 24 wherein a first group of said markings on said cover are concentric circles and a second group of said markings are numbers disposed between adjacent ones of said concentric circles and indicating degrees away from level, said ball being restable on said concave bottom of said base below said first group of markings and thereby indicating degrees away from level of a slope of the surface upon which said device is placed.

26. The device of claim 25 wherein said cover is rotatable on said base and further defines an arrow disposed at zero degrees and upon rotation of said cover being alignable with a target on the surface upon which said device is placed and a third group of said markings being lines and numbers labeling at least some of said lines and indicating the number of degrees said cover has been rotated away from a centerline of said rod such that an angle between said rod and the target can be measured.

27. The device of claim 24 wherein:

said base has a continuous side wall with an outer surface and an annular groove defined in and extending about said outer surface of said side wall; and said cover has a continuous side wall with an inner surface and an annular bead defined on and extending about said inner surface and seated within said annular groove in said side wall of said base for rotatably mounting said cover on said base.

28. The device of claim 27 wherein said cover has an outer surface with a series of parallel ribs thereon for aiding a golfer in gripping and rotating said cover.

29. The device of claim 24 wherein said cover incorporates a magnifying lens.

* * * * *